United States Patent [19]

Jones et al.

[11] 4,380,952

[45] Apr. 26, 1983

[54] COVER ASSEMBLY FOR VERTICAL EXHAUST PIPES

[75] Inventors: W. Richard Jones, North Barrington; Earl Conrad, Lake in the Hills, both of Ill.

[73] Assignee: Mercury Metal Products, Schaumburg, Ill.

[21] Appl. No.: 229,189

[22] Filed: Jan. 28, 1981

[51] Int. Cl.[3] ..... F23L 17/02

[52] U.S. Cl. ..... 98/59; 16/378; 98/122

[58] Field of Search ..... 98/59, 122; 16/378, 16/385, 273; 49/387; 308/18, 37, 120 R

[56] References Cited

U.S. PATENT DOCUMENTS

| | | | |
|---|---|---|---|
| 1,902,897 | 3/1933 | Robinson | 308/37 |
| 2,141,215 | 12/1938 | Leighton | 308/120 R X |
| 2,919,942 | 1/1960 | Bechtel | 308/22 X |
| 2,983,216 | 5/1961 | Stade et al. | 98/59 |
| 3,921,225 | 11/1975 | Suska | 16/273 |
| 4,059,045 | 11/1977 | McClain | 98/122 |
| 4,225,928 | 3/1981 | Jones et al. | 60/324 |
| 4,256,388 | 3/1981 | Beyer | 16/385 X |

*Primary Examiner*—William E. Tapolcai

*Attorney, Agent, or Firm*—Silverman, Cass & Singer

[57] ABSTRACT

A pivotally mounted cover assembly for the end of an upstanding exhaust pipe has a pivot structure constructed to include a plastic sleeve-type bearing pivotally mounted directly on a pivot shaft; the plastic bearing provides a seat for a flange member formed on the pivotal support arm of the cover member. A cover support arm including a pair of the aligned annular flanges mounted on separate, aligned plastic bearings facilitates assembly and replacement of the pivot structure and eliminates the need for an inner bearing. The cover assembly can further include notches on a pivot support member to receive locking tabs formed on a plastic bumper member which is engaged by stop members formed on the cover support arm to absorb the impact and reduce the noise as the pivotal cover reaches open and closed positions on the end of the pipe stack.

6 Claims, 4 Drawing Figures

FIG. 1 PRIOR ART ENVIRONMENT
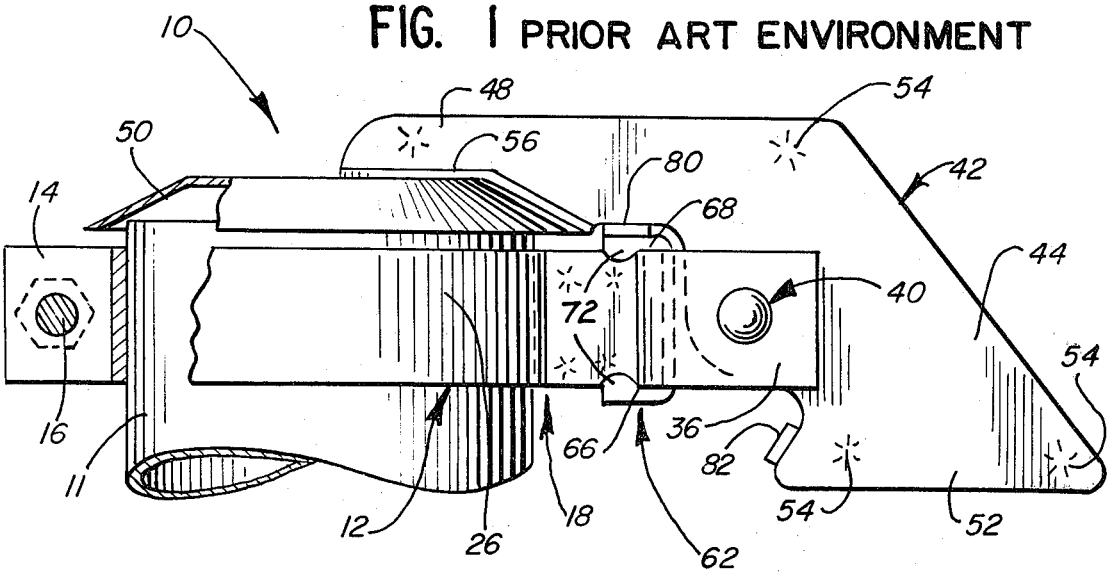
FIG. 2 PRIOR ART ENVIRONMENT
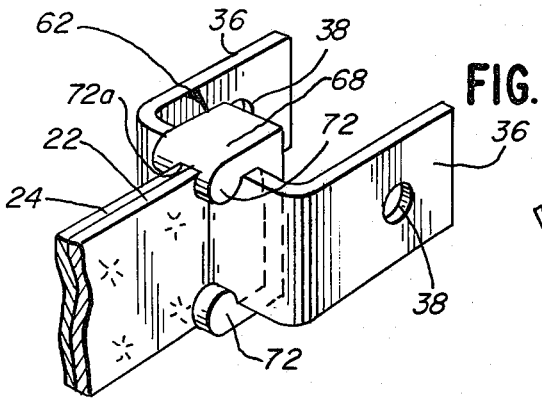
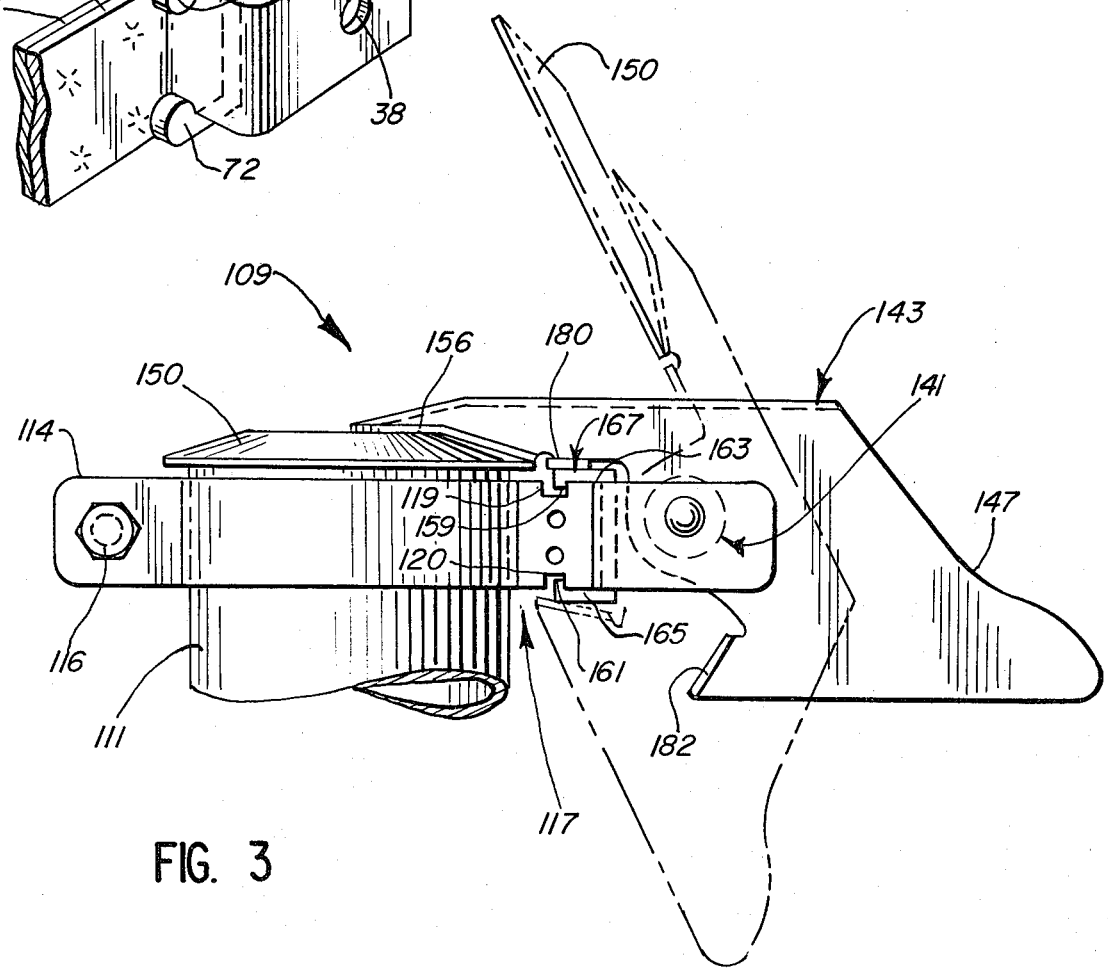
FIG. 3

FIG. 4
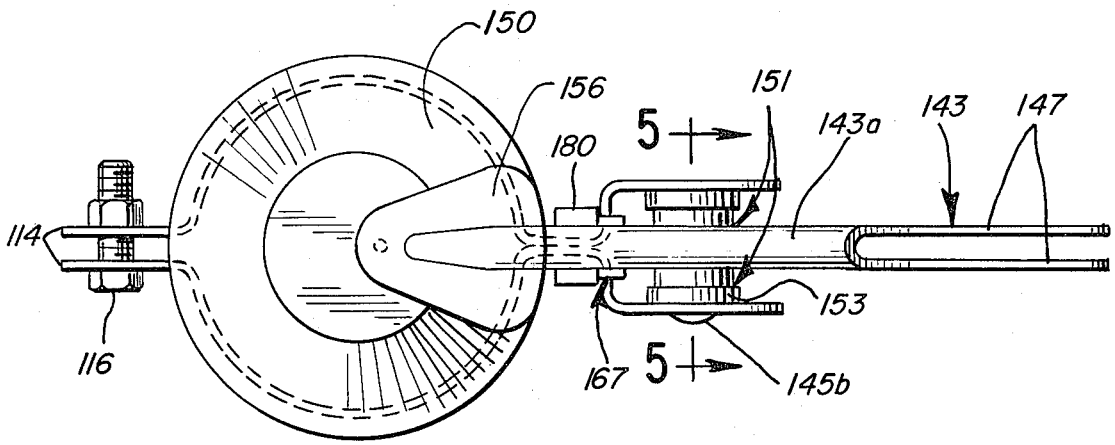
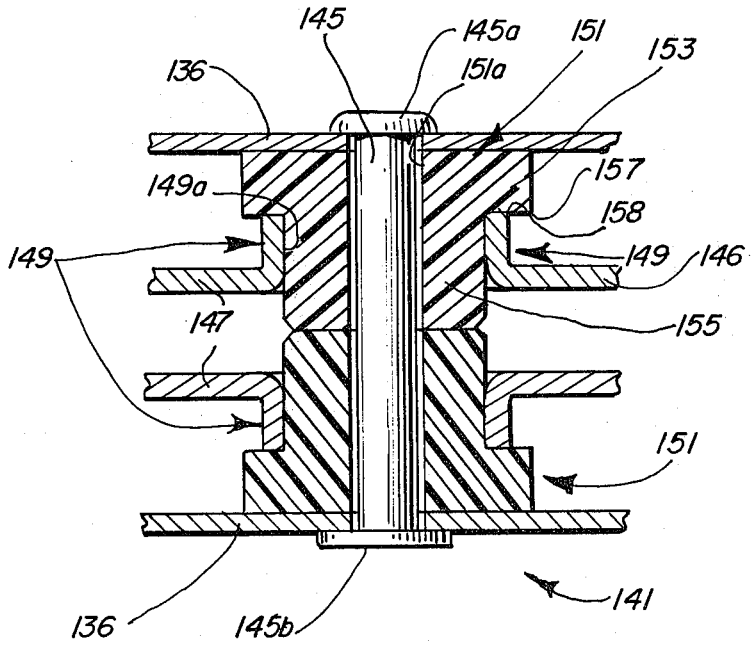
FIG. 5

COVER ASSEMBLY FOR VERTICAL EXHAUST PIPES

BACKGROUND OF THE INVENTION

This invention relates to a cover device typically used on the end of the exhaust stack of an internal combustion engine. More particularly this invention relates to improvements over the cover device described in U.S. Pat. Nos. 2,983,216 and 4,059,045 and in U.S. Patent application Ser. No. 967,990, filed Dec. 11, 1978, now U.S. Pat. No. 4,255,928, which are incorporated herein by reference.

The protective cover devices described in the aforementioned patents are designed to be pivotally mounted upon the upper ends of respective generally upright exhaust stacks of internal combustion engines maintained outdoors in order that the devices will cover the ends of the exhaust pipes when the engines are not operating to prevent entry of rain or debris into the stacks. When exhaust gases exert pressure in a stack pipe during operation of the engine, the cover is raised against gravity off the end of the pipe to permit the gases to escape. The movement of the cap between open and closed positions is a rocking movement about a pivot. The large inertia of a heavy cover member causes considerable shock on the bearing of the pivot structure upon impacts at open and closed positions of the cover as well as loud noise produced by such impacts. Consequently, durability of the pivot structure has required brazing of the cover support arm to a sintered metal bushing which is journaled on a bearing mounted on a pivot shaft, as more fully described in the aforementioned U.S. Pat. No. 4,059,045. In addition to being complex, this pivot assembly is difficult to repair or replace.

Solution to the problem with noisy impact at the open and closed positions of the cover had been solved by providing a plastic bumper member which receives the impacts by engagement of stops mounted on the pivotal support arm for the cover, as described in the aforementioned U.S. Patent application Ser. No. 967,990; however, such bumper members have required fabrication of a groove therein in order to secure mounting on a bracket for convenient removal and replacement of the plastic bumper member.

SUMMARY OF THE INVENTION

In accordance with this invention, a pivotal cover device for exhaust pipe stacks or the like includes a pivot support and mounting member having recesses or notches to receive locking tabs formed on a plastic bumper member. The bumper member is engaged by stop members formed on a cover support arm to receive the impact and reduce the noise as the pivotal cover reaches open and closed positions on the end of the pipe stack.

The pivot structure of the cover device can be constructed to include a flange member formed on the cover support arm which is mounted on a plastic bearing pivotally mounted directly on a pivot shaft. Preferably, the cover support arm includes a pair of aligned annular flanges mounted on separate, aligned plastic sleeve bearings; each sleeve bearing is formed with an integral collar to provide an annular shoulder formation which seats an annular foot formation on the respective flanges of the cover support arm.

BRIEF DESCRIPTION OF THE DRAWING

FIG. 1 is a side elevational view of a prior art protective cover assembly showing the environment in which the instant invention is employed;

FIG. 2 is fragmentary perspective view of a portion of the cover device of FIG. 1 showing the installation of the grooved bumper member;

FIG. 3 is a side elevational view of an embodiment of a cover assembly in accordance with this invention showing identations in the support bracket for reception of locking tabs on the bumper member;

FIG. 4 is a top plan view of the cover assembly shown in FIG. 3;

FIG. 5 is a fragmentary cross-sectional view taken through lines 5—5 of FIG. 4 and in the indicated direction, illustrating an embodiment of the pivot structure constructed in accordance with this invention.

FIGS. 1 and 2 illustrate a prior art cover device described in the aforementioned U.S. Patent application Ser. No. 967,990, which shows the environment in which the present invention can be employed.

The reference character 10 designates generally the rain cover device of FIG. 1 which is adapted to be clamped to an upstanding exhaust stack 11 typically emerging from an engine. In device 10, support member 12 is formed out of a pair of generally mirror configuration sheet metal straps 22 and 24 as more clearly shown in FIG. 2. The clamp member 12 has tab ends 14 formed at the left hand end of each of the straps 22 and 24 respectively, these being perforated to provide for the engagement of a bolt and nut 16 or other fastening means. The two straps 22 and 24 are welded together near their centers at a junction 18 for permanently securing the straps to one another. Between the welded juncture and tab ends 14 the straps are outwardly bowed at 26 to provide a pair of bights forming a clamping section to enable securement of the device to a stack.

At the right hand end of the support member 12 the free ends of the straps 22 and 24 are first bent outwardly at approximate right angles as indicated at bends 32 and 34 and then parallel to one another to provide the spaced parallel bifurcated section 36 as best seen in FIG. 2. The bifurcated section 36 is perforated as shown at 38 in FIG. 2 to receive the rivet or bolt which secures the pivot structure 40 to permit free rocking of the balance arm 42.

Pivot structure 40 includes one of the pivot means described in detail in the aforementioned U.S. Pat. Nos. 2,983,216 or 4,059,045, which have telescoped bushing and bearing members mounted on the rivet shaft in contrast to the pivot structure of this invention as shown in the embodiment of FIGS. 3, 4, and 5 described hereinafter.

Referring again to FIG. 1, the balance arm 42 is made out of a pair of identical sheet metal stampings 44 and 46 or a bifolded plate forming a front nose 48 that carries the cover member 50 and a rear counterweight vane 52. Stampings 44 and 46 are welded together face to face at several locations such as shown at 54. Integral flanges 56 bent outwardly from the stampings 44 and 46 are welded to the top of the cover member 50 as indicated at 58.

The cover member 50 is of shallow dish-like inverted form and it is intended to cover the upper end of an exhaust stack without touching the same as described hereinafter then the engine is not operating because the weight of the cover member 50 and the front end of the balance arm 42 on the left hand side of the pivot 40 is greater than the weight of the vane 52.

When the engine carrying the stack is operating exhaust gases will impel the cover member 50 from the cover position and cause it to pause in a clockwise direction about the pivot 40.

At the location along the support member 12 where the straps 22 and 24 separate into the right angle bends 32 and 34 there is engaged a removable bumper member 62 which is formed of a resilient material such as nylon or polytetrafluoroethylene. Bumper member 62 may be molded as an integral member and is of channel configuration, there being a back or base portion 64 and two arm parts 66 and 68. Each of the arm parts 66 and 68 is engaged over the junction 18 of the two straps 22 and 24 where they are welded together and where they are bent apart. This is best seen in the view of FIG. 2. The base portion 64 is engaged against bends 32 and 34 and is located in the bifurcated section 36. Thus arm 68 has a flat surface facing upward and the arm 66 has a flat surface facing downward engaged on the respective edges of junction 18.

Since bumper member 62 is composed of resilient material it is easily pressed onto or pulled from junction 18. To assist in holding it in place arms 66 and 68 have rounded projections such as shown at 72 which help pilot the bumper member 62 onto the rear of the junction when it is installed and will assist in its removal, these projections extending a slight distance below the upper edge of the support assembly 12 and a slight distance above the bottom edge of the support member or assembly 12. The projections 72 of each arm do not extend fully across the bumper member 62 but leave a space between them which forms a groove **72*a* at the top and bottom thereof to receive the edge of junction 18 as shown in FIG. 2**.

The movement of the balance arm 42 is limited by the bumper member 62 in cooperation with stop means that are provided on the balance arm. The stop means are provided by tabs integral with the stampings forming the balance arm 42 bent outwardly from the balance arm at 80 and at 82. In FIG. 1 tab 80 is shown engaged against bumper member 62, the former being located to the right of the cover member 50 and the latter being located at the front edge of the vane 52.

Movement in a rocking motion around the pivot 40 in a counterclockwise direction is limited by stop means 80 coming into engagement with the upper face of the arm 68 of bumper member 62. At this position the cover member 50 is suspended above the stack 11 although substantially closing the same off and not touching the same. Movement in a rocking movement which is clockwise around the pivot 40 is limited by the stop means 82 coming into engagement with the lower face of the arm 66. This is shown by the broken line position of similar balance arm 142 and stop means 182 in the embodiment of the invention shown in FIG. 3.

DESCRIPTION OF THE PREFERRED EMBODIMENT

FIG. 3 illustrates one embodiment of this invention in which structural members which are substantially the same as those shown in the cover device of FIG. 1 have been designated with the same reference numeral but with the addition of a preceding 1 which distinguishes the embodiment according to this invention. Thus, the cover device 109 shown in FIG. 3 is similar to cover device 10 shown in FIG. 1 in that both clamp members 12 and 112 are made out of strap members. Pivot structure 141, fastening means 116 and bumper member 167 are in substantial alignment so that both devices 10 and 109 have a low profile on the stack with vanes 52 and 147 both extending below the top of stack 11 and 111, respectively. Both cover devices 10 and 109 are conveniently installed on the stacks.

Referring to FIG. 4, balance arm body 143 comprises a pair of spaced, parallel plates 147 of the same or similar configuration including vane members **147*a* plates 147 are formed from a single blank of steel or the like which is reverse bent on bifold 143*a*. A portion of bifold 143*a* is overlapped and secured to cover 150 such as by welding thereto one or more flanges 156**.

Pivot structure 141, as shown best in FIG. 5, can be fabricated without requiring brazing of the annular plate flanges to a bushing or journaling of the bushing onto a separate sleeve bearing as described in the aforesaid U.S. Pat. No. 4,059,045. Referring to FIG. 5, pivot structure 141 includes spaced, bifurcated ear members 136 each having an aligned aperture 138 through which a rivet shaft or bolt 145 is positioned for pivotally mounting balance arm body 143 between ears 136 so that cover 116 will be biased to cover the open end of exhaust conduit 111. Rivet shaft 145 has enlarged head ends **145*a* and 145*b* engaging the outer surfaces of respective ears 136**.

As shown in FIGS. 4 and 5, plates 147 are provided with aligned annular flanges 149 respectively while annular flanges 149 can be formed so that they project inwardly toward each other, they are preferably formed so that they extend outwardly, as shown in FIG. 5. Through the passageway **149*a* in each of annular flanges 149 a separate, generally cylindrical bearing structure 151 is preferably force fitted so that the bores 151*a* in the bearing structures 151 are aligned to receive rivet 145 therethrough to provide a sleeve-type bearing for pivotal support for the balance arm. Each sleeve-type bearing structure 151 includes a collar flange 153 preferably integrally joined at one end of a body 155 having a smaller outer diameter to provide an annular shoulder formation 157**.

Bearing structure 151 is frictionally engaged through each plate flange 149 with the annular foot 158 formed on each flange 149 engaging annular shoulder formation 157 in addition to seating of annular flange 149 on the outer surface of bearing body 155. Preferably, the bearing structures 151 are dimensioned in length so that the annular end surfaces of bodies 155 are firmly engaged against each other with bearings 151 forming a bridge between ears 136 so that collar structures 153 are firmly engaged against the inside surface of respective ears 136.

In contrast to the staked connection of a telescopic outer bushing required to provide a thickened portion in the bearing constructions as described in the aforementioned U.S. Pat. No. 2,983,218, the two bearing structures 151 are inserted into respective passageways **149*a* to facilitate assembly of the pivot structure 141 and do not require a separate inner bearing. While both bearing structures 151 can be fabricated from metal, they are preferably formed from an engineering plastic, for example nylon 66, polytetrafluoroethylene or polyoxyethylene which can provide the needed strength and toughness. Nylon 66 is well suited for this application because of its high tensile and impact strength, good abrasion resistance and self-lubricating service as a bearing for pivot on rivet 145, thus eliminating the need for any inner bearing. Extrusion of bearing structures 151** can be achieved or conventional manner and conventional equipment.

In contrast to the junction 18 of support member 12 shown in FIG. 1 cover device 109 shown in FIG. 3 has a junction 117 in which the upper and lower edges thereof are provided with generally aligned notches 119 and 120 which receive respective locking tabs 159 and 161 inwardly projecting from respective arm parts 163 and 165 of resilient bumper member 167. Thus, locking tabs 159 and 161 can extend fully across bumper member 167 and need not be interrupted in order to provide the required groove in the projections 72 of the bumper member 62 as shown in FIG. 1 for reception of the edge of junction 18. The notches 119 and 120 formed in junction 117 eliminate the need to fabricate grooves into locking tabs 159 and 161 so that bumper member 167 can be made by merely cutting a length of channel-shaped extrusion of engineering plastic, such as nylon 66 without further fabrication.

Variations are capable of being made without departing from the spirit or scope of the invention as defined in the appended claims.

What it is desired to secure by Letters Patent of the United States is:

We claim:

1. A gravity actuated protective cover device adapted to be secured upon an upstanding exhaust stack of an internal combustion engine to prevent entry of extraneous matter therein during the inoperative condition of the engine and comprising:

A. a support member adapted to be secured to the exhaust stack and having a pivot structure mounted thereon, the support member having a clamping formation to straddle and be clamped to the exhaust stack which includes adjustable fastening means, said support member being formed of a pair of metal straps of generally mirror construction connected face to face, the pivot structure and fastening means being generally aligned horizontally when the support member is installed on a stack, B. a balance arm mounted on said pivot structure for rocking movement about said pivot structure in a vertical plane, the balance arm having a cover member connected to the front end thereof and a counter-weight vane, the vane and cover member being on respective opposite sides of the pivot structure, the balance arm being adapted for said rocking movement between two positions, one of which is with the cover member disposed over the end of the exhaust stack but without touching the same, the other position being with the cover member substantially rotated away from the stack, C. the balance arm being heavier on the cover member side of the pivot than on the vane of the pivot so that the normal condition of the balance arm is with the cover member in the first of said positions when the engine is not operating, D. said straps having ear portions thereof spaced apart to provide a bifurcated portion in which the pivot structure is mounted with said balance arm straddled by said ear portions, and wherein said pivot structure comprises (1) a pair of aligned annular flanges with axial passageways therethrough laterally formed on said balance arm, and (2) a pair of generally cylindrical plastic sleeve bearings pivotally mounted in axial alignment on a pivot shaft member passing through said ear portions so that each of said bearings is fitted within a respective one of said passageways to seat said respective annular flange thereon, wherein at least one of said sleeve bearings comprises a generally cylindrical body having an annular collar flange formed on one end of said body and positioned so that said collar flange engages a respective one of said ear portions in order to limit axial movement of said sleeve bearing on said pivot shaft.

2. The cover device as claimed in claim 1 wherein said sleeve bearings are engaged endwise in said alignment on said pivot shaft member.

3. The cover device as claimed in claim 1 wherein said balance member comprises a sheet metal member formed as a pair of plates connected by a reverse fold whereby the plates are parallel one with the other and each plate has said angular flange protruding outwardly relative to one another.

4. A gravity actuated protective cover device adapted to be secured upon an upstanding exhaust stack of an internal combustion engine to prevent entry of extraneous matter therein during the inoperative condition of the engine and comprising:

A. a support member adapted to be secured to the exhaust stack and having a pivot structure mounted thereon, the support member having a clamping formation to straddle and be clamped to the exhaust stack which includes adjustable fastening means, said support member being formed of a pair of metal straps of generally mirror construction connected face to face, the pivot structure and fastening means being generally aligned horizontally when the support member is installed on a stack, B. a balance arm mounted on said pivot structure for rocking movement about said pivot structure in a vertical plane, the balance arm having a cover member connected to the front end thereof and a counter-weight vane, the vane and cover member being on respective opposite sides of the pivot structure, the balance arm being adapted for said rocking movement between two positions, one of which is with the cover member disposed over the end of the exhaust stack but without touching the same, the other position being with the cover member substantially rotated away from the stack, C. the balance arm being heavier on the cover member side of the pivot than on the vane side of the pivot so that the normal condition of the balance arm is with the cover member in the first of said positions when the engine is not operating, D. said straps having ear portions thereof spaced apart to provide a bifurcated portion in which the pivot structure is mounted with said balance arm straddled by said ear portions, and wherein said pivot structure comprises (1) a pair of aligned annular flanges with axial passageways therethrough laterally formed on said balance arm, and (2) a pair of generally cylindrical plastic sleeve bearings pivotally mounted in axial alignment on a pivot shaft member passing through said ear portions so that each of said bearings is fitted within a respective one of said passageways to seat said respective annular flange thereon, wherein at least one of said sleeve bearings comprises a generally cylindrical body having an annular collar flange formed on one end of said body and positioned so that said collar flange engages a respective one of said ear portions in order to limit axial movement of said sleeve bearing on said pivot shaft, and further wherein said collar and body form an annular shoulder which seats an annular foot formed on said respective flange for further stabilization of said balance arm on said pivot structure.

5. The cover device as claimed in claim 4, wherein said balance arm comprises a pair of stop members formed on an edge thereof, said cover device further comprising a resilient bumper member mounted on said straps in the path of movement of said stop members whereby to limit said rocking movement and prevent engagement of said balance arm with any other part of said cover device or the end of said stack.

6. The cover device as claimed in claim 5, wherein said straps comprise a juncture formation in which they are connected in face to face engagement and said straps further comprise a pair of generally aligned bends which join said juncture formation and one end of said bifurcated portion; and said resilient bumper means comprise a channel-shaped plastic member having a base and an upper and lower arm, said bumper means being positioned so that said upper and lower arms engage upper and lower edges of said juncture formation, respectively, and said base engages said bends, and wherein said upper and lower arms are arranged in the path of movement of said stop members for respective engagement therewith in order to limit rocking movement of said balance arm to prevent engagement of said balance arm with said support structure or said stack end, wherein said bumper means further comprise a tab projection extending from the end of at least one of said arms into a notch formation in said juncture formation for securing the mounting and positioning of said bumper means upon said support member.

* * * * *